United States Patent [19]

Bender

[11] 4,024,648

[45] May 24, 1977

[54] SAFETY FLASK FOR FREEZE DRYING

[76] Inventor: Charles E. Bender, P.O. Box 247, Fairfield, Pa. 17320

[22] Filed: Oct. 22, 1975

[21] Appl. No.: 624,606

[52] U.S. Cl. ..... 34/92

[51] Int. Cl.[2] ..... F26B 13/30; F26B 25/14

[58] Field of Search ..... 34/5, 92

[56] References Cited

UNITED STATES PATENTS

| | | | |
|---|---|---|---|
| 3,138,937 | 6/1964 | Parkinson et al. | 34/5 X |
| 3,246,674 | 4/1966 | Kapeker | 34/5 X |
| 3,293,773 | 12/1966 | Frazer et al. | 34/92 |
| 3,474,543 | 10/1969 | Bender et al. | 34/92 X |

*Primary Examiner*—John J. Camby

*Attorney, Agent, or Firm*—Lawrence J. Winter

[57] ABSTRACT

A safety flask for freeze drying being formed of chemically-resistant and shock-resistant materials, including a container flask, a cover assembly and a tube removably inserted through the cover assembly so as to be in communication with the interior of the container flask for connection to a vacuum source. Sealing means is mounted in the cover assembly to provide a fluid-tight seal between the tube and the cover assembly. A filter is removably mounted on the cover assembly over the point of communication of the tube with the container flask to prevent cross-contamination between samples and to prevent the sample from being withdrawn by the vacuum. A vacuum release device is mounted on the tube to permit easy removal of the flask.

9 Claims, 3 Drawing Figures

SAFETY FLASK FOR FREEZE DRYING

BACKGROUND OF THE INVENTION

This invention relates in general to a freeze drying apparatus and, more particularly, to a safety flask particularly adapted for use in freeze drying and similar laboratory procedures.

Freeze drying has been found useful in many fields, such as food technology, analysis of organic materials., and other uses. It is ordinarily used where the need exists to remove water or other vaporizable liquids from a substance without destroying its cellular structure. Freeze drying has the unique capability of allowing a controlled rate of evaporation of the vaporizable liquid from the material so that, in escaping, the velocity of the vapor particles is not so great that it will damage the residual material. Specimens or materials are usually freeze dried in either a chamber-type freeze dryer or a nipple-type freeze dryer, using discrete containers.

There are a number of prerequisites, however, that any vessel or specimen container must have before it may be used in freeze drying, in order to overcome the various problems encountered in this operation. One problem includes the stress created due to the sudden subjection of the container to the sub-zero temperatures necessary for quick freezing, which could result in the tendency to crack and/or shatter many materials.

Another problem involves the procedure employed for the application and release of the vacuum. Various types of specimens require the application of extreme care to avoid damage when the vacuum is applied or released. Should the vacuum be applied too suddenly, varying amounts of the samples may be drawn into the vacuum source. Likewise, extreme care must be taken to release the vacuum gently, or a loss of sample may result through excessive agitation by the inrushing air. In addition, the sample container must be fluid-tight in order to be satisfactory for freeze drying procedures. For the purposes of this invention, the word "fluid " will encompass both the properties of a liquid and that of a gas or vapor.

An example of a free drying apparatus which is not sufficiently protected against vacuum leakage is U.S. Pat. No. 3,293,722 (D.S. Frazer et al. ) which provides only one sealing means on its connector tube and, further, depends on a threaded cap to secure such a seal. This arrangement, if properly sealed every time, would lead to a shortened life expectancy of the sealing means involved and the possibility of vacuum leakage, with the adverse consequences.

Other problems presented in freeze drying are that the solvents evaporated from the sample may be corrosive or otherwise damaging to the specimen container. Thus, while the container is generally a delicate piece of apparatus and must be handled and supported with a great degree of care to negate the danger of implosion or breakage, it is desirable that it be easy to clean after each use.

SUMMARY OF THE INVENTION

In order to solve these various problems, the safety freeze drying flask of the present invention was developed. The flask or vessel includes a sample container open at one end, a cap or cover assembly, and a connecting tube or adapter. The cap has an opening through which the connecting tube to the vacuum source is inserted securely so that it is in communication with the interior of the container when the cap is secured to the top opening thereof. A filter is mounted over the communicating opening of the connecting tube in the interior of the flask bottom by a retainer and supported by cloth screens.

The filter constitutes an improvement over that offered in U.S. Pat. No. 3,293,773 in that while the latter presents difficulty in leakages, removal, cleaning, and provides no means of support for the filter, the present invention provides for easy installation and replacement of the filter, presents no problems in leakages, and is supported by sturdy metal, cloth or plastic grids.

Attached to the connecting tube on the outside of the flask is a vacuum release valve which serves to open the interior of the freeze drying flask when subject to a vacuum to the pressures of the ambient atmosphere. This release valve is an advance over and superior to that in the prior art in that its position assures an even influx of air through the filter and upon the sample inside the container. This release valve attains such a desirable result by being at the furthest distance from the sample, thereby evenly distributing the airstream through the filter so as to not disturb the dried sample, which may be fluffy or light in density. Thus, the filter will not be torn by the force of the onrushing air, nor will the sample be disturbed.

In an embodiment of the present invention, the container itself is composed of a tough, durable and chemically-resistant material such as a suitable plastic or the like. The filter used over the opening is of a type used to preclude bacteria and virus and yet be permeable to gases. The connecting tube rests on a resilient annulus, such as an o-ring or the like, in addition to a sealing means around its outside diameter, thereby forming a tight seal for the retention of vacuum. The cover assembly is secured by any means, such as a bayonet joint, threads or the equivalent, to the container. A silicone gasket is interposed between the cover and container to facilitate the retention of vacuum.

A better appreciation of the novel features of the present invention will be had upon a consideration of the following objects and detailed description.

It is therefore an object of this invention to provide a new and improved flask for use in freeze drying samples of various compositions.

It is a further object of this invention to provide a new and improved apparatus of uncomplicated design adapted for use in freeze drying without encountering the risk of contamination of the vacuum system.

It is yet a further object of the present invention to provide a freeze drying apparatus which is shock-resistant and resistant to most chemicals.

It is a still further object of the present invention to provide a new and improved freeze drying apparatus which is economically manufactured and assembled.

A still further object of this invention is to provide a new and improved freeze drying apparatus which is autoclavable and easily cleanable.

Objects other than those set forth will become apparent upon consideration of the accompanying drawings and detailed description to follow:

Figure 1:
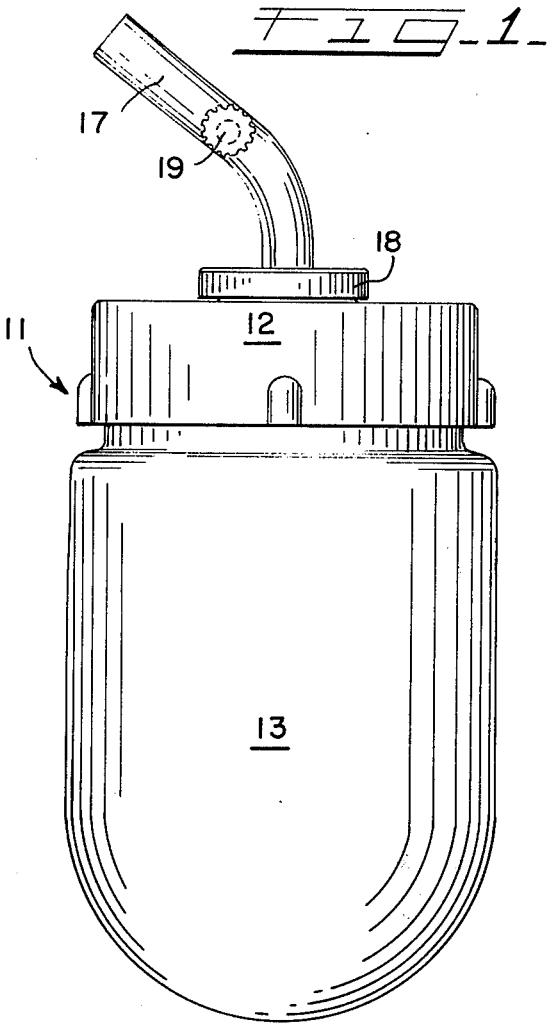
FIG. 1 is a side view of a preferred embodiment of the present invention.

The safety flask 11 shown in FIG. 1 has a cover assembly 12 and a sample container 13. This sample container 13 is preferably formed from a material such as polycarbonate or polymethylpentene to give it strength and durability in the face of strong solvent action or sudden changes of temperature.

Figure 2:
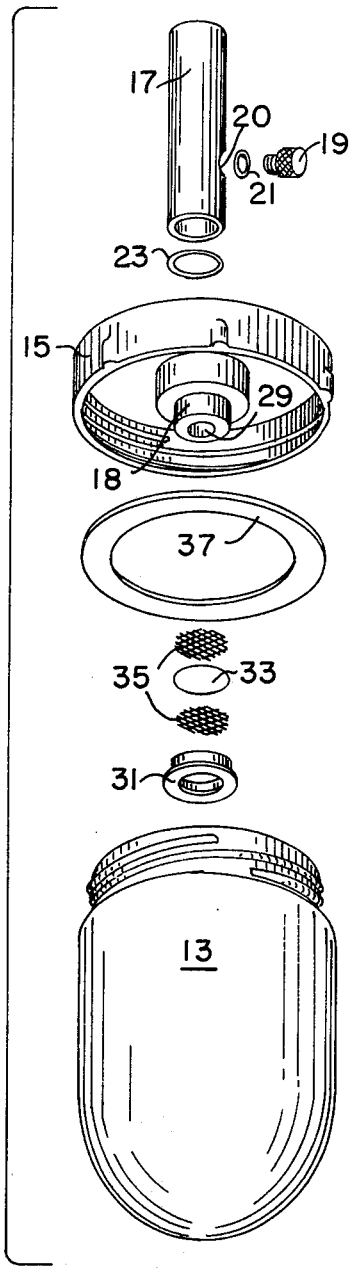
FIG. 2 is an exploded side view in perspective of a preferred embodiment of the present invention taken in cross section.

The cover assembly 12 is composed of a plurality of parts, as can be seen in FIG. 2. A silicone rubber gasket 37 is placed between a container cover 15 and a sample container 13, thereby assuring an essentially leakproof enclosure. The cover assembly 12 has a plug or adapter 18 which fits into an opening in the container top 15. This plug 18 itself has an opening 29 for the admission of the adapter or connector tube 17. The adapter tube 17 rests on an o-ring 24, which is supported by a shoulder 23 on the interior walls of the plug opening 29.

Seats 28 are provided at various points on the exterior walls of the plug 18 for the placement of o-rings 27 which serve to seal the connection between the container top 15 and the plug 18, thereby further assuring a leakproof assembly. An o-ring 25 is also placed in another of the seats 28 within the opening 29, to aid in retention of vacuum at that point.

The adapter tube 17 has a vacuum release knob 19 threadedly secured in an opening 20 and sealed by an o-ring 21. By turning this knob 19 and thereby loosening the seal formed by the o-ring and the tightened threads, the vacuum may be gently released. This release is uniquely engineered so that the vacuumm may not be released suddenly without a conscious effort on the part of the operator. The release knob 19 must be unscrewed totally for such a sudden and violent release, and without such a complete withdrawal of the release knob from the adapter tube, a controlled, gentle release of vacuum will always be effectuated, thus avoiding any disturbance of the dried sample by the inrushing air.

Figure 3:
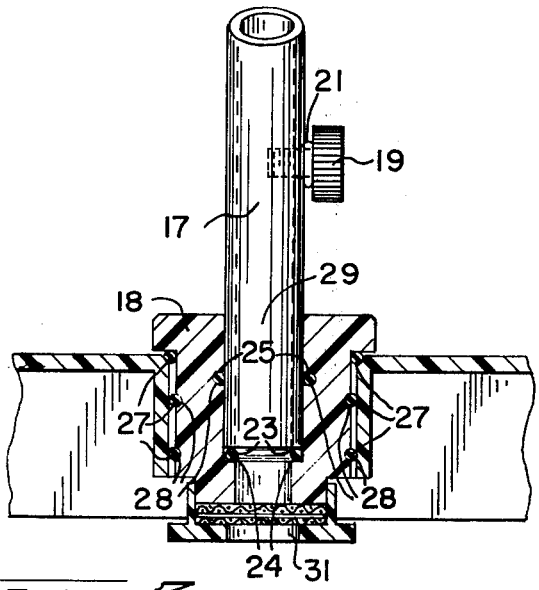
FIG. 3 is a cross section of the cover assembly of a preferred embodiment of the present invention.

A filter 33, supported by a cloth mesh screen 35, is held in place over the opening 29 of the adapter 18 by a retaining or supporting cap 31. The relationship of support screens 35 to the filter 33 is shown more clearly in FIG. 3, where the filter 33 is sandwiched between the two support screens 35 in such a manner that the filter will not collapse under the stress of the vacuum forces. Thus, the filter will catch all of the airborne sample which would ordinarily be lost to the vacuum source (not shown) upon the sudden application of the vacuum. This also guards against cross-contamination of the sample through the vacuum lines. This also keeps the sample intact so it may then be collected and measured in a manner known to those skilled in the art to provide for a true measure to compare with the original sample. The retainer cap 31 is of such dimensions as to maintain a close fit over the adapter plug 29, so that it will not fall of upon agitation or the influx of air encountered upon the release of the vacuum.

It is obvious that the adapter 18 and the container cover 15 may be integrally formed thereby eliminating the o-rings 27 and also increasing the assurance of a vacuum tight seal.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments flowing within the scope of the appended claims.

I claim:

1. A vessel assembly for freeze drying formed of materials resistant to chemical, thermal and shock action comprising a sample container open at one end, a cover assembly disposed over said opening said cover assembly having a central opening with a shoulder formed therein in communication with said container a cylindrical adapter disposed in said opening having a central passageway extending therethrough, said adapter having an enlarged head and a reduced bottom portion extending into said central opening and said adapter having a shoulder adjacent its reduced portion resting on said central opening shoulder, recess means on the exterior middle portion of said adapter and sealing means disposed in them to form a seal with said central opening, other recess means on the interior of said passageway with sealing means disposed therein, a connector tube for communication with a vacuum source extending into said passageway adjacent a shoulder formed therein and bearing against sealing means on said passageway shoulder, an annular retainer cap inserted in said central opening, a filter disposed in said cap sandwiched between perforated support means, and vacuum release means inserted through the wall of said connector tube including a threaded member with an o-ring disposed thereon to provide a seal for said opening.

2. The vessel assembly of claim 1 wherein the sample container is high-impact plastic.

3. The vessel assembly of claim 2 wherein said high-impact plastic forming said sample container is a polycarbonate.

4. The vessel assembly of claim 2 wherein said high-impact plastic forming said sample container is a polymethylpentene.

5. The vessel assembly of claim 1 wherein a silicone rubber gasket is disposed between said cover assembly and said sample container, achieving said leakproof manner of attachment of said cover assembly to said sample container.

6. The vessel assembly of claim 1 wherein said filter means is disposable.

7. The vessel assembly of claim 1 wherein said connector means is formed of a polycarbonate.

8. The vessel assembly of claim 1 wherein said connector means is formed of stainless steel.

9. The vessel assembly of claim 1 said cover assembly and said adapter means are integrally formed.

* * * * *